US005553520A

United States Patent [19]

Jacobs

[11] Patent Number: 5,553,520

[45] Date of Patent: Sep. 10, 1996

[54] OPEN-END SELF-ADJUSTING RATCHET WRENCH

[76] Inventor: Leonard P. Jacobs, 328 Dogwood Rd., Millersville, Md. 21108

[21] Appl. No.: 391,934

[22] Filed: Feb. 21, 1995

[51] Int. Cl.[6] ..... B25B 13/28

[52] U.S. Cl. ..... 81/90.1; 81/58.2; 81/179

[58] Field of Search ..... 81/90.1, 90.9, 81/91.1, 179

[56] References Cited

U.S. PATENT DOCUMENTS

| | | | |
|---|---|---|---|
| 2,700,315 | 1/1955 | Hermanson | 81/90.1 X |
| 4,440,047 | 4/1984 | Robbins | 81/179 |
| 5,282,830 | 2/1994 | Reynolds | 81/90.1 |

FOREIGN PATENT DOCUMENTS

| | | | |
|---|---|---|---|
| 3106510 | 9/1982 | Germany | 81/90.1 |

*Primary Examiner*—James G. Smith

[57] ABSTRACT

An open-end self-adjusting ratchet wrench comprising a generally C-shaped head portion defining a holding space sized for receiving a fastener therein, a ratcheting surface formed on the head portion and facing the holding space, and a plurality of circumferentially spaced notches formed on the ratcheting surface in communication with the holding space; a handle coupled to the head portion; and a spring-loaded tooth mechanism extendably seated within the notches of the head portion for applying a grip to a fastener disposed within the holding space of the head portion when the handle is torqued in one direction and for releasing the grip of the fastener when the handle is torqued in an opposite direction.

3 Claims, 3 Drawing Sheets

OPEN-END SELF-ADJUSTING RATCHET WRENCH

BACKGROUND OF THE INVENTION

1. Field of the Invention

The present invention relates to an open-end self-adjusting ratchet wrench and more particularly pertains to tightening and loosening fasteners such as nuts, bolts, and the like with an open-end self-adjusting ratchet wrench.

2. Description of the Prior Art

The use of ratchet wrenches is known in the prior art. More specifically, ratchet wrenches heretofore devised and utilized for the purpose of tightening or loosening fasteners are known to consist basically of familiar, expected and obvious structural configurations, notwithstanding the myriad of designs encompassed by the crowded prior art which have been developed for the fulfillment of countless objectives and requirements.

By way of example, U.S. Pat. No. 320,725 to Rubesh discloses an open end ratchet wrench. U.S. Pat. No. 3,892,150 to Horton discloses a self-adjusting open or closed-end ratchet wrench. U.S. Pat. No. 4,324,159 to Wrobbel discloses an open end ratchet wrench. U.S. Pat. No. 4,441,387 to Hendricks discloses an open-end ratchet wrench. U.S. Pat. No. 4,479,409 to Antonius discloses an open-end ratchet wrench. U.S. Pat. No. 4,554,347 to De Santis discloses an open-end ratchet wrench.

While these devices fulfill their respective, particular objective and requirements, the aforementioned patents do not describe an open-end self-adjusting ratchet wrench that uses a plurality of spring loaded teeth that are extended for gripping a fastener when the handle of the wrench is turned in one direction and are retracted for releasing the grip on the fastener when the handle of the wrench is turned in another direction, thereby allowing a ratcheting motion to be effected.

In this respect, the open-end self-adjusting ratchet wrench according to the present invention substantially departs from the conventional concepts and designs of the prior art, and in doing so provides an apparatus primarily developed for the purpose of tightening and loosening fasteners such as nuts, bolts, and the like.

Therefore, it can be appreciated that there exists a continuing need for new and improved open-end self-adjusting ratchet wrench which can be used for tightening and loosening fasteners such as nuts, bolts, and the like. In this regard, the present invention substantially fulfills this need.

SUMMARY OF THE INVENTION

In the view of the foregoing disadvantages inherent in the known types of ratchet wrenches now present in the prior art, the present invention provides an improved open-end self-adjusting ratchet wrench. As such, the general purpose of the present invention, which will be described subsequently in greater detail, is to provide a new and improved open-end self-adjusting ratchet wrench and method which has all the advantages of the prior art and none of the disadvantages.

To attain this, the present invention essentially comprises, in combination, a rigid handle having a C-shaped head defining a holding space sized for receiving a fastener therein, a base end, and an intermediate holdable portion extended in curvature therebetween. The head portion further has a pair of opposed side faces with a ratcheting surface extended therebetween and facing the holding space. The ratcheting surface has a plurality of circumferentially spaced notches formed therealong. The notches are placed in communication with the holding space. Each notch defines a hollow interior and an opening to the interior. The interior of each notch is bounded by an upper surface portion, a lower surface portion, and a curved guiding surface portion extended therebetween to further define an upper seating juncture and a lower seating juncture. The upper surface portion further has a planar upper pressure application surface, an angled upper blocking surface, and a downwardly protruding outboard lock therebetween. The lower surface portion further has an angled recessed surface positioned below the upper pressure application surface and extended to the ratcheting surface, a planar lower pressure application surface positioned below the upper blocking surface, and an upwardly protruding inboard lock positioned therebetween and located in general opposition to the outboard lock. The locks divide the interior of the notch into an inner part and an outer part.

A plurality of rigid teeth are included. Each tooth is separately disposed within one of the notches. Each tooth has an inboard portion and an outboard portion. Each inboard portion is disposed within the inner part of the associated notch of the head portion. Each outboard portion is disposed within and extendable from the outer part of the associated notch of the head portion. Each outboard portion further has a leading edge, a trailing edge extended to the leading edge to define a gripping point for gripping a fastener disposed within the holding space, an upper abutment edge extended from the trailing edge and positionable in facing contact with the upper pressure application surface of the head portion, and an upper locking surface extended downwards from the upper abutment edge and positioned in contact with the outboard lock of the head portion. Each inboard portion has a lower locking surface positioned in facing contact with the inboard lock of the head portion, a seat with a J-shaped cross-section positioned in slidable contact with the guiding surface of the head portion and movable therealong between the upper seating juncture and the lower seating juncture, a lower abutment edge extended between the seat and the lower locking surface and positionable in facing contact with the lower pressure application surface of the head portion, and a trailing edge extended from the seat to the upper locking surface.

An elongated flexible spring is disposed within the inner part of each notch of the head portion. Each spring has one end positioned in forcible contact within the upper seating juncture of the head portion and another end positioned in forcible contact with the seat of the associated tooth. The spring is positionable in a general rest configuration with the lower abutment edge of the associated tooth positioned in facing contact with the lower pressure application surface of the head portion and thereby extending the gripping point of the associated tooth outwards for contact with a fastener disposed within the holding space. The spring is further positionable in a biased configuration with the leading edge of the associated tooth positioned in facing contact with the associated recessed surface of the head portion and thereby retracting the gripping point from contact with a fastener disposed within the holding space.

Lastly, a pair of opposed C-shaped rigid mounting plates is provided. Each plate is coupled to the one of the side faces of the head portion. The mounting plates thereby seal the inner parts of the notches.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved open-end self-adjusting ratchet wrench which has all the advantages of the prior art ratchet wrenches and none of the disadvantages.

It is another object of the present invention to provide a new and improved open-end self-adjusting ratchet wrench which may be easily and efficiently manufactured and marketed.

It is a further object of the present invention to provide a new and improved open-end self-adjusting ratchet wrench which is of durable and reliable construction.

An even further object of the present invention is to provide a new and improved open-end self-adjusting ratchet wrench which is susceptible of a low cost of manufacture with regard to both materials and labor, and which accordingly is then susceptible of low prices of sale to the consuming public, thereby making such a open-end self-adjusting ratchet wrench economically available to the buying public.

Still yet another object of the present invention is to provide a new and improved open-end self-adjusting ratchet wrench which provides in the apparatuses and methods of the prior art some of the advantages thereof, while simultaneously overcoming some of the disadvantages normally associated therewith.

Even still another object of the present invention is to provide a new and improved open-end self-adjusting ratchet wrench for tightening and loosening fasteners such as nuts, bolts, and the like.

Lastly, it is an object of the present invention to provide a new and improved open-end self-adjusting ratchet wrench comprising a generally C-shaped head portion defining a holding space sized for receiving a fastener therein, a ratcheting surface formed on the head portion and facing the holding space, and a plurality of circumferentially spaced notches formed on the ratcheting surface in communication with the holding space; a handle coupled to the head portion; and spring-loaded teeth means seated within the notches of the head portion for applying a grip to a fastener disposed within the holding space of the head portion when the handle is torqued in one direction and for releasing the grip of the fastener when the handle is torqued in an opposite direction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
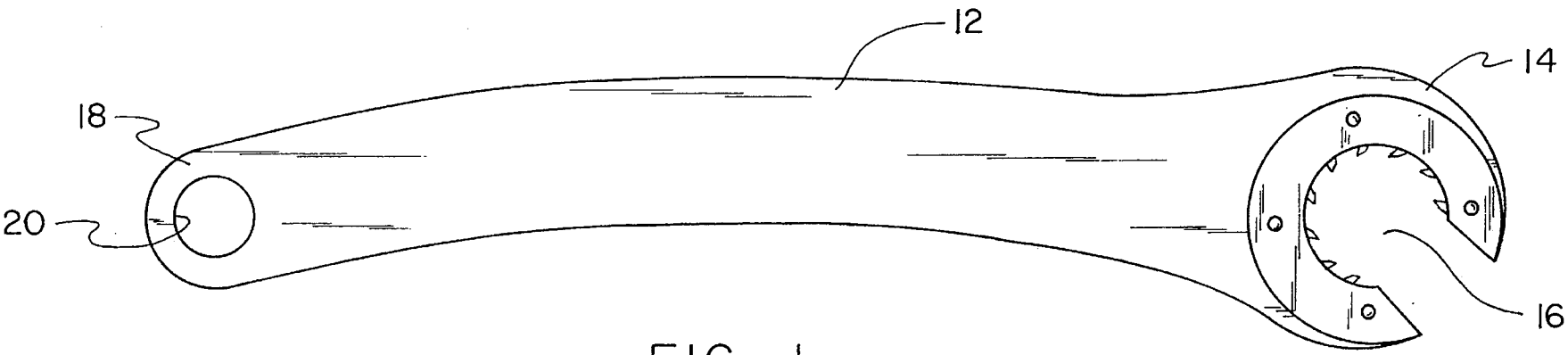
FIG. 1 is a side-elevational view of the preferred embodiment constructed in accordance with the principles of the present invention.

With reference now to the drawings, and in particular, to FIG. 1 thereof, the preferred embodiment of the new and improved open-end self-adjusting ratchet wrench embodying the principles and concepts of the present invention and generally designated by the reference number 10 will be described.

The present invention is comprised of a plurality of components. In their broadest context, such components include a handle, teeth, springs, and mounting plates. Such components are individually configured and correlated with respect to each other to provide the intended function of providing a structure tightening and loosening fasteners such as nuts, bolts, and the like with ratcheting action.

Specifically, the present invention includes a handle 12. The handle is formed of a rigid material such as metal. The handle has a C-shaped head portion 14. The head portion defines and generally peripherally encompasses a holding space 16. The holding space is sized for receiving a fastener such as a nut or bolt therein for tightening or loosening. The handle also has a base end 18 with a general circular through hole 20 formed thereon for allowing the present invention to be carried on a loop or hung from a wall. The handle also has an intermediate holdable portion 22 extended in curvature between the head portion 14 and the base end 18. The curved portion generally conforms to the palm of a user's hand. The head portion 14 also includes a pair of opposed planar C-shaped side faces 24 with a curved ratcheting surface extended therebetween. The ratcheting surface is positioned such that it faces the holding space. The ratcheting surface has a plurality of circumferentially spaced notches 28 formed therealong about the holding space. The notches are generally aligned in a common plane and are further placed in communication with the holding space 16.

Figure 5:
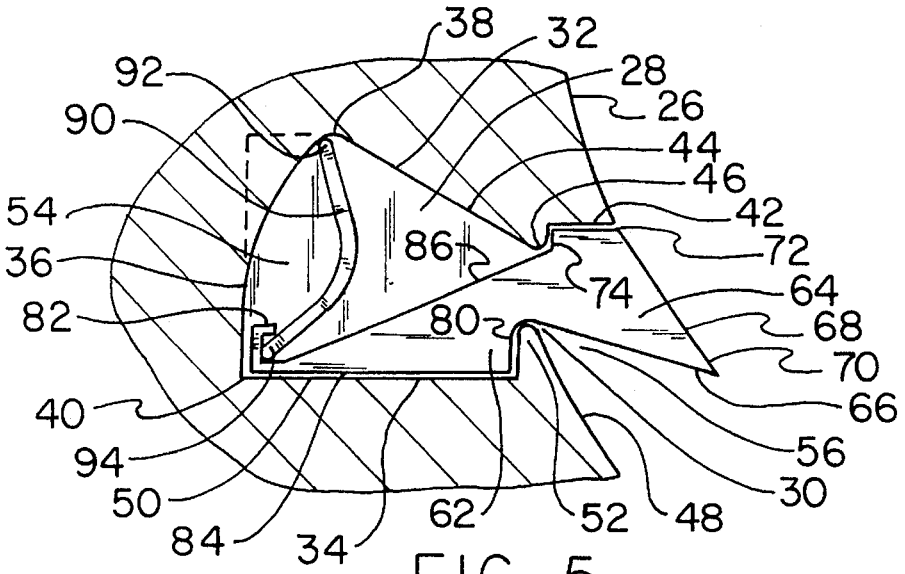
FIG. 5 is an enlarged cross-sectional view of a toothed portion of the present invention as shown in FIG. 3.

As best illustrated in FIG. 5, each notch defines a hollow interior, opposed open sides, and an opening 30 for allowing access to the interior. The opening is positioned facing the holding space. The interior of the notch is bounded by an upper surface portion 32, a lower surface portion 34, and a curved guiding surface portion 36 extended between and connected to the upper surface portion and the lower surface portion. The connection of the guiding surface portion with the upper surface portion and lower surface portion further defines an upper seating juncture 38 and a lower seating juncture 40. The upper seating juncture has a radius of curvature greater than that of the guiding surface portion. The lower seating juncture forms a corner.

In addition, the upper surface portion has a generally planar upper pressure application surface 42, a straight and angled upper locking surface 44, and a downwardly protruding outboard lock 46 positioned therebetween. The outboard lock has a tip extent with a radius of curvature less than that of the the upper seating juncture 38. The lower surface portion includes an angled recessed surface 48. The recessed surface is positioned below and in general opposition to the upper pressure application surface and is further extended upwards to meet the ratcheting surface 26. The lower surface portion also includes a planar lower pressure application surface 50. The pressure application surface 50 is positioned below and in opposition to the upper locking surface 44. An upwardly protruding inboard lock 52 is positioned between the lower pressure application surface 50 and the angled recessed surface 48. The inboard lock 52 has a tip extent with a radius of curvature essentially equal to that of the outboard lock. The inboard lock 52 is located in general opposition to the outboard lock 46. The locks 46, 52 generally divide the interior of the notch 28 into an inner part 54 and an outer part 56.

A plurality of extendable teeth 60 are also included. Each tooth is formed of a rigid material such as metal. Each tooth is separately disposed within one of the notches 28 of the head portion. Each tooth has an inboard portion 62 and an outboard portion 64. Each inboard portion is positioned within the inner part 54 of the associated notch. Each outboard portion is disposed within and extendable from the outer part 56 of the associated notch of the head portion. Each outboard portion has a leading edge 66 and a trailing edge 68 extended to the leading edge to create a gripping point 70 and an angle of between about 30 to 45 degrees between the edges 66, 68. The gripping point is used for gripping a fastener that is disposed within the holding space 16. The outboard portion also includes an upper abutment edge 72 extended away from the trailing edge to create an angle of about 110 to 135 degrees between the edges 68, 72. The upper abutment edge 74 is positionable in facing contact with the upper pressure application surface 42 of the head portion. Lastly, the outboard portion includes an upper locking surface 74 extended downwards from the upper abutment edge 72 to thereby create an angle of between about 90 to 110 degrees between the edges 72, 74. The upper locking surface 74 is positioned in contact with the outboard lock 46 of the head portion.

Each inboard portion 62 of each tooth includes a lower and generally inverted J-shaped locking surface 80. The lower locking surface is positioned in facing contact with the inboard lock 52 of the head portion. The inboard portion also includes a seat 82. The seat has a generally J-shaped cross-section. The seat includes a long leg, a short leg with a free end, and a cross leg extended therebetween. The seat is positioned in slidable contact with the guiding surface 36 of the head portion 14. The seat is movable along the guiding surface between the upper seating juncture 38 and the lower seating juncture 40. In addition, a lower abutment edge 84 is extended between the seat 82 and the lower locking surface 80 to thereby create an angle of about 90 to 110 degrees between locking surface 80 and edge 84. The lower abutment edge is positionable in facing contact with the lower pressure application surface 50 of the head portion. Lastly, a trailing edge 86 is extended from the seat 82 to the upper locking surface 74 to thereby create an angle of between about 30 to 50 degrees between surface 74 and edge 86.

As shown in FIG. 5, an elongated flexible metal spring 90 is disposed within the inner part 54 of each notch 28 of the head portion 14. Each spring has one rounded end 92 positionable in forcible contact with the upper seating juncture 38 of the head portion. Another rounded end 94 of the spring is positionable in forcible contact with the seat 82 of the associated tooth. A spring is positionable in a rest configuration with the lower abutment edge 84 of the associated tooth positioned in facing contact with the lower pressure application surface 50 of the head portion. In the rest position, the spring has tension placed on it. The spring extends the gripping point 70 of the associated tooth outwards for contact with a fastener that is disposed within the holding space 16. This extension is obtained when the handle is torqued in one direction for tightening. The point 70 thus grips the fastener and is held in place with the lower abutment edge 84 in contact with the lower pressure application surface 50 as well as the upper abutment edge 72 in contact with the upper pressure application surface 42. The spring is further positionable in a biased configuration. An increased amount of tension is placed on the spring when in the biased position as compared to the rest position. In the biased configuration, the leading edge 56 of the associated tooth is retracted in facing contact or juxtaposition with the associated recessed surface 48 of the head portion. This retraction occurs when the handle 12 is turned in an opposite direction, thereby allowing the trailing edge 68 to be abutted against a fastener within the holding space and further retracting the gripping point 70. Retracting action of the tooth is allowed to occur through pivoting contact of the outboard lock 46 with the upper locking surface 74 and trailing edge 86 as well as pivoting contact of the inboard lock 52 with the lower locking surface 80 and leading edge 66. When the teeth are retracted, each trailing edge 68 is positioned essentially flush with the ratcheting surface 26 thereby allowing the handle to be turned in preparation for another twist or turn for tightening. Thus, a ratcheting action is obtained.

Figure 2:
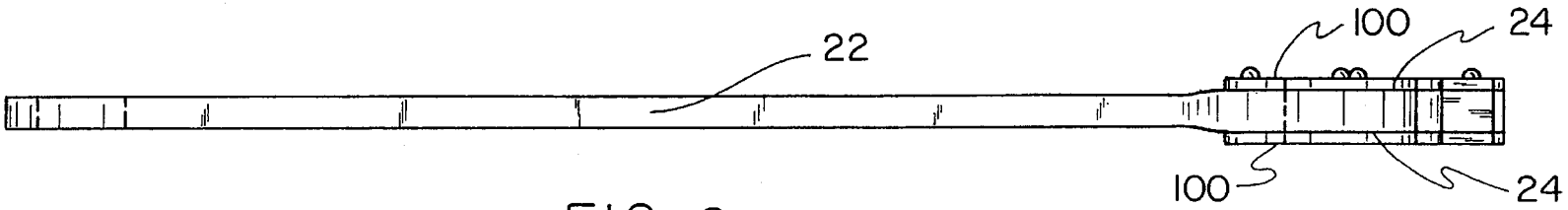
FIG. 2 is a plan view of the preferred embodiment of the present invention.
Figure 3:
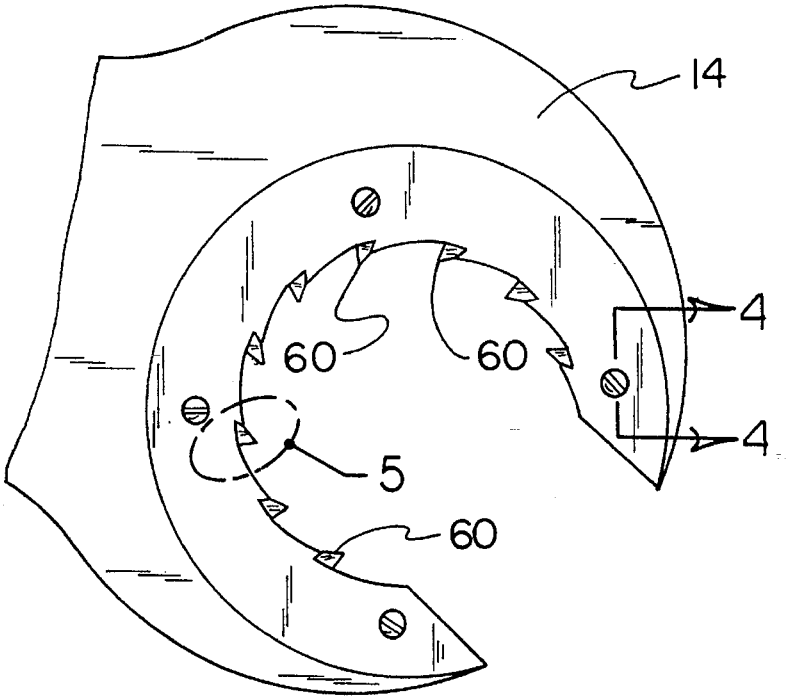
FIG. 3 is an enlarged fragmentary view of the head portion of the present invention.
Figure 4:
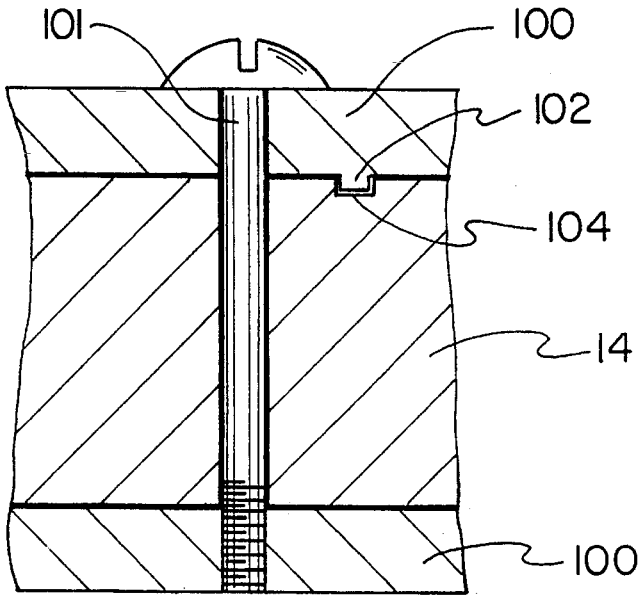
FIG. 4 is a cross-sectional view of the present invention taken along the line 4–4 of FIG. 3.

Lastly, a pair of opposed C-shaped mounting plates 100 are included. Each mounting plate is formed of a rigid material such as metal. Each mounting plate is coupled to one of the side faces 24 of the head portion with threaded fasteners 101 as shown in FIGS. 2 and 4. To preclude the plates from slipping, each plate has a knob 102 extended therefrom and seated within a complimentary notch 104 formed on the side face 24. The mounting plates thus seal the inner parts of the notches and further seal the inboard portion 62 of the teeth in an operable configuration.

Figure 6:
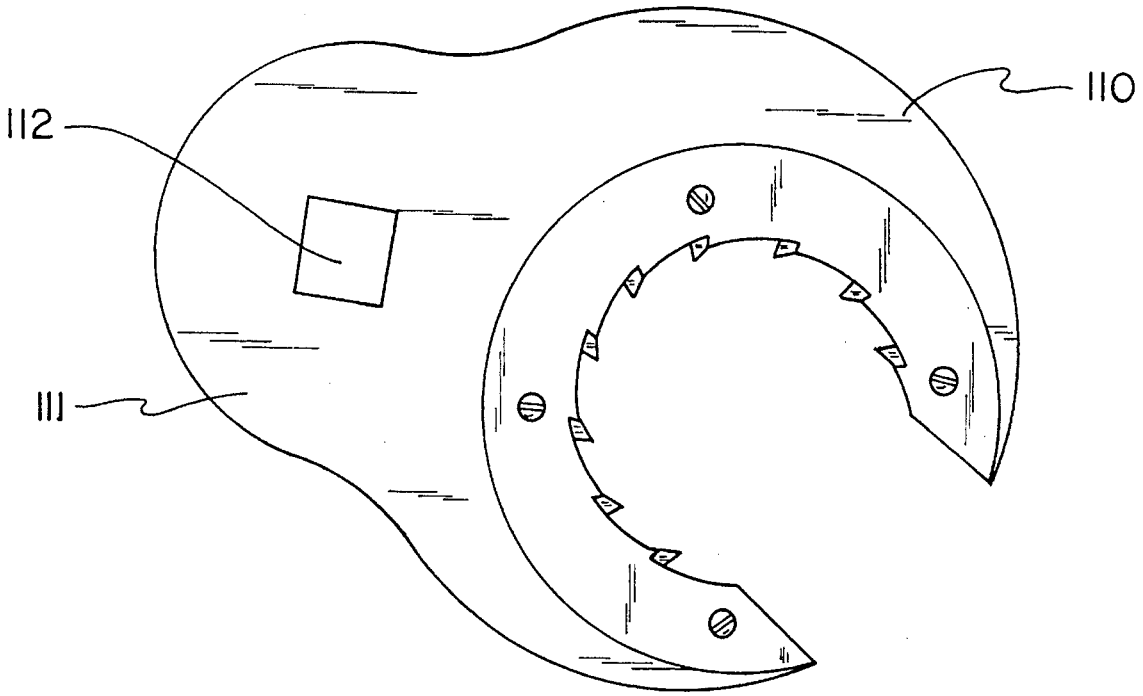
FIG. 6 is a side-elevational view of an alternate embodiment of the present invention.

A second embodiment of the present invention is shown in FIG. 6. This embodiment includes substantially all of the components of the present invention except that the handle 12 is removed. A generally C-shaped head portion with a stem 111 projected therefrom is now provided. The stem includes a square through hole disposed therethrough. The through hole is adapted to receive a torquing rod for serving as a lever in the tightening and loosening processes. When the head portion is secured to a torquing rod, the present invention may be used for tightening or loosening fasteners using ratcheting action as previously described.

The spring of the present invention has a thickness of about 0.003 inches. The upper pressure application surface and the lower pressure application surface are the only surfaces in contact with the tooth when tightening is being performed. Tightening action is effected when the handle is turned in a direction thereby to allow the gripping point to move toward the fastener with the spring positioned in a rest position. Ratcheting action is effected when the handle is turned in a direction thereby to allow the gripping point to retract away the fastener with the spring positioned in a biased position. The spring-loaded teeth of the present invention are allowed to slide back in the notches to form the ratcheting effect when the handle is reciprocated. The teeth are forced back out via the springs to obtain a grip on a fastener. Each tooth is about 0.50 inches in height by about 0.300 inches in width by about 0.150 inches in thickness.

In an alternate embodiment as shown in FIG. 6, the head portion is detached from the holdable portion of the handle. A ⅜ inched square through hole is formed through the head. The through hole is adapted for receiving an extension wrench or rod. The holding space of the present invention present invention can be minimally sized to hold an 8 mm type fastener. Larger sizes can also be fashioned for use with larger fasteners having a size greater than 8 mm.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An open-end self-adjusting ratchet wrench for tightening and loosening fasteners such as nuts, bolts, and the like comprising, in combination:

a rigid handle having a C-shaped head portion defining a holding space sized for receiving a fastener therein, a base end, and an intermediate holdable portion extended in curvature therebetween, the head portion further having a pair of opposed side faces with a ratcheting surface extended therebetween and facing the holding space and with the ratcheting surface having a plurality of circumferentially spaced notches formed therealong and placed in communication with the holding space, each notch defining a hollow interior and an opening to the interior and with the interior bounded by an upper surface portion, a lower surface portion, and a curved guiding surface portion extended therebetween to further define an upper seating juncture and a lower seating juncture, the upper surface portion further having a planar upper pressure application surface, an angled upper locking surface, and a downwardly protruding outboard lock therebetween, the lower surface portion further having an angled recessed surface positioned below the upper pressure application surface and extended to the ratcheting surface, a planar lower pressure application surface positioned below the upper locking surface, an upwardly protruding inboard lock positioned therebetween and located in general opposition to the outboard lock and with the locks dividing the interior into an inner part and an outer part;

a plurality of rigid teeth, each tooth separately disposed within one of the notches, each tooth having an inboard portion and an outboard portion, each inboard portion disposed within the inner part of the associated notch, each outboard portion disposed within and extendable from the outer part of the associated notch of the head portion, each outboard portion further having a leading edge, a trailing edge extended to the leading edge to define a gripping point for gripping a fastener disposed within the holding space, an upper abutment edge extended from the trailing edge and positionable in facing contact with the upper pressure application surface of the head portion, and an upper locking surface extended downwards from the upper abutment edge and positioned in contact with the outboard lock of the head portion, each inboard portion having a lower locking surface positioned in facing contact with the inboard lock of the head portion, a seat with a J-shaped cross-section positioned in slidable contact with the guiding surface of the head portion and movable therealong between the upper seating juncture and the lower seating juncture, a lower abutment edge extended between the seat and the lower locking surface and positionable in facing contact with the lower pressure application surface of the head portion, and a trailing edge extended from the seat to the upper locking surface;

an elongated flexible spring disposed within the inner part of each notch of the head portion, each spring having one end positioned in forcible contact within the upper seating juncture of the head portion and another end positioned in forcible contact with the seat of the associated tooth, the spring positionable in a rest configuration with the lower abutment edge of the associated tooth positioned in facing contact with the lower pressure application surface of the head portion and thereby extending the gripping point of the associated tooth outwards for contact with a fastener disposed within the holding space, the spring further positionable in a biased configuration with the leading edge of the associated tooth positioned in facing contact with the associated recessed surface of the head portion and thereby retracting the gripping point from contact with a fastener disposed within the holding space; and a pair of opposed C-shaped rigid mounting plates with each plate coupled to the one of the side faces of the head portion and with the mounting plates thereby sealing the inner parts of the notches.

2. An open-end self-adjusting ratchet wrench comprising:

a generally C-shaped head portion defining a holding space sized for receiving a fastener therein, a ratcheting surface formed on the head portion and facing the holding space, and a plurality of circumferentially spaced notches formed on the ratcheting surface in communication with the holding space;

a handle coupled to the head portion; and spring-loaded teeth means seated within the notches of the head portion for applying a grip to a fastener disposed within the holding space of the head portion when the handle is torqued in one direction and for releasing the grip of the fastener when the handle is torqued in an opposite direction;

wherein each notch defines a hollow interior and an opening to the interior and with the interior bounded by an upper surface portion, a lower surface portion, and a curved guiding surface portion extending therebetween to further define an upper seating juncture and a lower seating juncture, the upper surface portion further having an upper pressure application surface, an upper locking surface, and a downwardly protruding outboard lock therebetween, the lower surface portion further having a recessed surface extended to the ratcheting surface, a planar lower pressure application surface, an upwardly protruding inboard lock positioned therebetween and located in general opposition to the outboard lock and with the locks dividing the interior into an inner part and an outer part;

wherein the spring-loaded teeth means includes a plurality of rigid teeth, each tooth separately disposed within one of the notches, each tooth having an inboard portion and an outboard portion, each inboard portion disposed within the inner part of the associated notch, each outboard portion disposed within and extendable from the outer part of the associated notch of the head portion, each outboard portion further having a leading edge, a trailing edge extended to the leading edge to define a gripping point for gripping a fastener disposed within the holding space, an upper abutment edge extended from the trailing edge and positionable in facing contact with the upper pressure application surface of the head portion, and an upper locking surface extended downwards from the upper abutment edge and positioned in contact with the outboard lock of the head portion, each inboard portion having a lower locking surface positioned in facing contact with the inboard lock of the head portion, a seat positioned in slidable contact with the guiding surface of the head portion and movable therealong between the upper seating juncture and the lower seating juncture, a lower abutment edge extended between the seat and the lower locking surface and positionable in facing contact with the lower pressure application surface of the head portion, and a trailing edge extended from the seat to the upper locking surface;

a flexible spring disposed within each notch of the head portion, each spring having one end positioned in contact within the upper seating juncture of the head portion and another end positioned in contact with the Seat of the associated tooth.

3. An open-end self-adjusting ratchet wrench comprising:

a generally C-shaped head portion defining a holding space sized for receiving a fastener therein, a ratcheting surface formed on the head portion and facing the holding space, a plurality of circumferentially spaced notches formed on the ratcheting surface in communication with the holding space, each notch defining a hollow interior and an opening to the interior and with the interior bounded by an upper surface portion and a lower surface portion, the lower surface portion having an upwardly protruding inboard lock dividing the interior into an inner part and an outer part, the lower surface portion further having a recessed surface extended from the inboard lock;

a plurality of rigid teeth, each tooth separately disposed within one of the notches, each tooth having an inboard portion and an outboard portion, each inboard portion disposed within the inner part of the associated notch, each outboard portion disposed within and extendable from the outer part of the associated notch of the head portion, each outboard portion further having a leading edge and a trailing edge extended to the leading edge to define a gripping point for gripping a fastener disposed within the holding space, each inboard portion having a lower locking surface positioned in facing contact with the inboard lock of the head portion such that the tooth can pivot about the inboard lock until the leading edge abuts the recessed surface;

a flexible spring disposed within each notch of the head portion, each spring having one end positioned in contact with the hollow interior of the notch and another end positioned in contact with the associated tooth.

* * * * *